US005235744A

United States Patent [19]

Arakawa et al.

[11] Patent Number: 5,235,744

[45] Date of Patent: Aug. 17, 1993

[54] METHOD OF MANUFACTURING A CENTRIFUGAL PUMP CASING

[75] Inventors: Shinichiro Arakawa, Chigasaki; Isamu Ichiki, Yokohama, both of Japan

[73] Assignee: Ebara Corporation, Tokyo, Japan

[21] Appl. No.: 913,337

[22] Filed: Jul. 15, 1992

Related U.S. Application Data

[62] Division of Ser. No. 546,804, Jul. 2, 1990, Pat. No. 5,184,937.

[30] Foreign Application Priority Data

Jul. 5, 1989 [JP] Japan ..... 1-173194
Jun. 14, 1990 [JP] Japan ..... 2-156762

[51] Int. Cl.[5] ..... B23P 15/00
[52] U.S. Cl. ..... 29/888.02; 29/888.024
[58] Field of Search ..... 29/888.024, 888.02, 29/428, 463, 469.5; 415/182.1, 203, 204, 206, 212.1, 215.1, 214.1

[56] References Cited

U.S. PATENT DOCUMENTS

| | | | |
|---|---|---|---|
| 3,466,724 | 9/1969 | Morris, Sr. | 29/888.024 |
| 4,676,717 | 6/1987 | Willyard, Jr. et al. | 29/888.024 |
| 5,040,946 | 8/1991 | Caoduro | 415/182.1 |
| 5,040,947 | 8/1991 | Kajiwara | 415/206 |
| 5,069,599 | 12/1991 | Carretta | 415/182.1 |

FOREIGN PATENT DOCUMENTS

| | | | |
|---|---|---|---|
| 9113260 | 9/1991 | World Int. Prop. O. | 29/888.024 |

*Primary Examiner*—Irene Cuda
*Attorney, Agent, or Firm*—Nikaido, Marmelstein, Murray & Oram

[57] ABSTRACT

A centrifugal pump casing of a centrifugal pump, includes a casing shell accommodating a rotary impeller therein and having as a basic circle an inner peripheral circle having a diameter greater than the diameter of the outer peripheral circle of the impeller. A bulged portion bulged radially outwardly is integrally formed on the outer peripheral wall of the casing shell, the bulged portion extends from a starting point remote from the winding starting point of the casing shell in a circumferential direction to an end point while gradually increasing in height in the direction from the starting point to the end point. A pipe-like discharge nozzle is connected with the casing shell so that it extends between the end point where the bulged portion is highest and the winding starting point where no bulged portion is formed. In this arrangement, since the bulge height above the basic circle is not so great even at the end point where a maximum height is reached, the bulged portion can be formed through only one pressing process without the need for an annealing process. Further, since the difference in height between the end point where the bulged portion is highest and the winding starting point where no bulged portion is formed is not so great, the wall portion of the casing shell at the winding starting point can serve as a guide; and accordingly, a guide for discharge water which is required in the prior art may be eliminated.

5 Claims, 6 Drawing Sheets

METHOD OF MANUFACTURING A CENTRIFUGAL PUMP CASING

This is a division of application Ser. No. 07/546,804 filed Jul. 2, 1990, now U.S. Pat. No. 5,184,937.

BACKGROUND OF THE INVENTION

1. Field of the Invention

The present invention relates to a centrifugal pump casing, and especially, to a centrifugal pump casing used in a centrifugal pump having a small size and capacity.

2. Prior Art

In general, a centrifugal pump rotatably accommodating an impeller in its casing shell is well known.

Recently, in a pump of this type, it has been proposed to integrally form the casing shell by means of deep drawing of a steel plate by using a press machine.

As shown in FIG. 5, for example, a casing shell 23 is integrally formed by means of pressing work, which has as a basic circle an inner peripheral circle 22 having a diameter slightly greater than the outer peripheral diameter 21 of the impeller 20, and the outer peripheral wall of the casing shell 23 is integrally formed with a bulged portion 23*a* bulging radially outwardly from the outer peripheral wall of the casing shell. The bulged portion extends from a winding starting point b of the casing shell in the circumferential direction to an end point c while its height gradually increases in the direction from the winding starting point to the end point. And at the end point c, where the bulge height of the bulged portion 23 is maximum, a discharge nozzle 25 is welded to the casing shell.

According to this arrangement, the inside of the casing shell 23 is formed with a volute room A which has a cross-sectional area gradually increasing in the direction of the fluid flow direction. The end point of the volute room A is provided with guide 26 having a projecting shape for decreasing the flow resistance of the fluid flow towards the discharge nozzle 25.

The necessary amount of the cross-sectional area of the volute room A at the end point c is determined on the basis of the fluid flow rate and the fluid flow speed.

Therefore, as in the prior art, if a bulged portion 23*a* having a height gradually increasing in the direction from the winding start point b to the end point c is formed on the outer peripheral wall of the casing shell 23, the bulged height h at the end point c becomes excessively high in order to obtain a necessary cross-sectional area of the flow passage at the end point c.

In this arrangement, therefore, there is a problem that the so-called bulge forming using a press machine requires repeated pressing process together with annealing processes.

Further, the prior art has another problem in that it is necessary to arrange a guide 26 having a projecting shape at the end point c of the volute room A to decrease the flow resistance of the fluid flow towards the exhaust nozzle 25. Without such a guide 26, the pump performance will be decreased.

SUMMARY OF THE INVENTION

Therefore, the object of the present invention is to provide a centrifugal pump casing which can overcome the above-mentioned problems of the prior art, and in which the bulged portion can be formed by a single pressing process without the need for annealing processes, and the pump performance is not decreased even if the projected guide is not provided at the end point of the volute room.

To achieve the above-mentioned object of the present invention, a centrifugal pump casing according to the present invention comprises, a casing shell accommodating a rotary impeller therein and having as a basic circle an inner peripheral circle having a diameter greater than the diameter of the outer peripheral circle of said impeller. A bulged portion bulged radially outwardly is integrally formed on the outer peripheral wall of the casing shell. This bulged portion extends from a starting point remote from the winding starting point of the casing shell in a circumferential direction to an end point while gradually increasing in height in the dimension from the starting point to the end point. And a pipe-like discharge nozzle is connected to the casing shell so that it extends between the end point where the bulged portion is highest and the winding starting point where no bulged portion is formed.

According to the present invention, since the casing shell has as a basic circle an inner peripheral circle having a diameter greater than the diameter of the outer peripheral circle of the impeller, and the bulged portion bulging radially outwardly is formed on the outer peripheral wall of the casing shell so that it extends from a starting point remote from the winding starting point of the casing shell in a circumferential direction to an ending point while gradually increasing in height in the direction from the starting point to the ending point, the bulge height above the basic circle is not so great even at the ending point where a maximum height is reached, and, therefore, the bulged portion can be formed by a single pressing process without the need for an annealing process. Further, since the pipe-like discharge nozzle is connected to the casing shell so that it extends between the end point where the bulged portion is at its highest and the winding starting point where no bulged portion is formed, the wall portion of the casing shell at the winding starting point may serve as a guide for discharge water, and accordingly, there is required no guide having a projecting shape, which is required in the prior art.

According to a preferred embodiment of the invention, a wall portion of the casing shell on its suction side is formed to have a concave mirror shape with the pump suction port being open at the central portion thereof and the inside of the concave wall portion is provided with an annular supporting plate. An outer peripheral portion of the supporting plate is secured to an inner surface of the wall portion while an inner peripheral portion thereof is bent toward the impeller and formed in a cylindrical shape. A connecting pipe is disposed to extend between the cylindrically shaped inner peripheral portion and the pump suction port included in the wall portion, and one end thereof is welded to the pump suction port in the wall portion while the other end thereof is press fitted within the inner peripheral portion of the supporting plate.

By this arrangement, the ability of the casing shell to resist the internal pressure is improved and, consequently, strain imposed on the casing shell caused by the internal pressure may be effectively limited.

Thus, a problem in the conventional pump casing, i.e. weakening of a casing shell by deep drawing thereof is solved.

In another preferred embodiment of the invention, a nozzle element having the shape of a bent pipe is disposed within the pipe-like discharge nozzle. An outlet portion of the nozzle element is fixed to the inside of the discharge nozzle and an inlet opening of the nozzle element is directed toward the volute room at the end point where the bulged height of the bulged portion is highest. The sectional area of the inlet opening of the nozzle element is made substantially the same as the sectional area of the volute room at its end point and the sectional area of the nozzle element is gradually increased toward the outlet portion thereof.

In this embodiment, when a pumped liquid flowing from the volute room toward the discharge nozzle enters the nozzle element, the velocity of the liquid is gradually decreased in this nozzle element, and, thereafter, the liquid is discharged from the discharge nozzle. Thus, a part of the kinetic energy of the pumped liquid is effectively converted into potential energy to increase pump pressure during a decrease in velocity and, therefore, the pump performance can be improved.

BRIEF DESCRIPTION OF THE DRAWINGS

The above and other objects, features and advantages of the present invention will become more apparent from the following description of the preferred embodiments thereof, taken in conjunction with the accompanying drawings, in which like reference numerals denote like elements and, of which.

DESCRIPTION OF THE PREFERRED EMBODIMENTS

Figure 1:
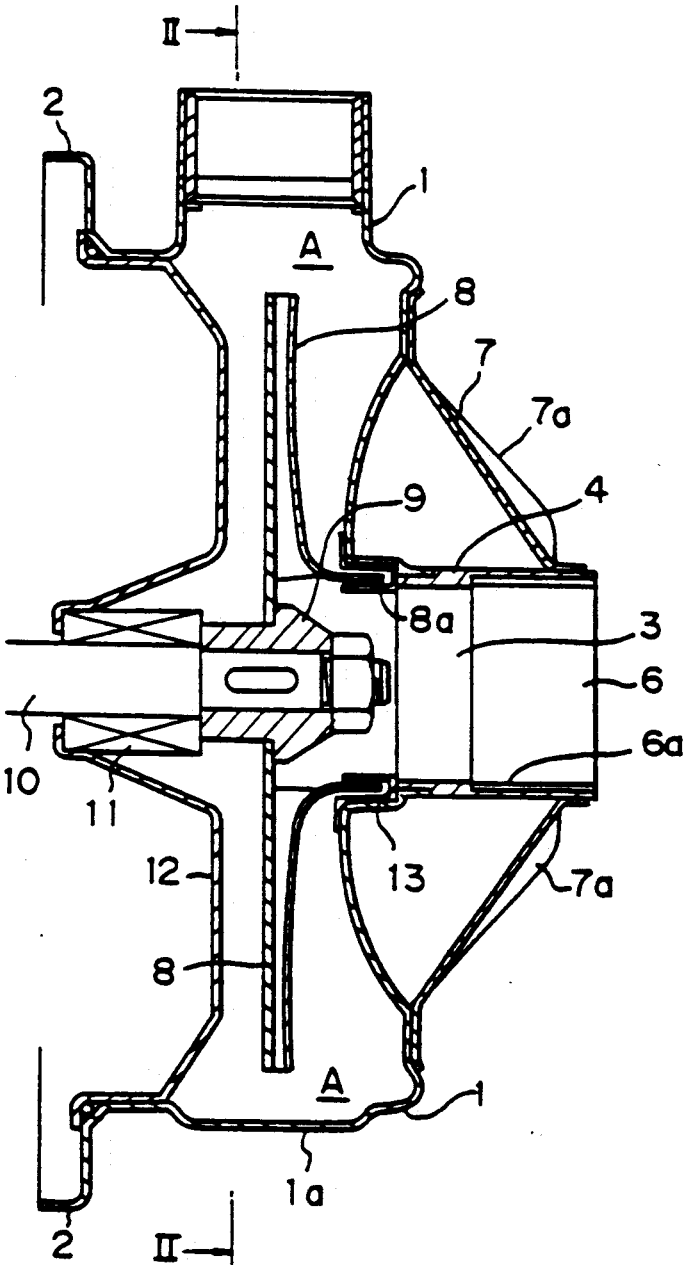
FIG. 1 is a longitudinal sectional view of an centrifugal pump casing according to an embodiment of the present invention.

Referring to the attached drawings, centrifugal pump casings according to embodiments of the present invention will be described below.

Reference characters $h_1$, $h_2$, and h, respectively show the height of the bulged portion. $B_1$, $B_2$ and B, respectively show the width of the bulged portion. $h_1$ is $<h_2$ and $<h$, and $B_1<B_2<B$; therefore, the height and the width of the bulged portion gradually increase from a starting point toward an ending point of the bulged portion.

In FIG. 1, numeral 1 denotes a casing shell of a centrifugal pump, which is formed by deep drawing a single steel plate using a pressing machine. The casing shell 1 is integrally formed with a fixing flange 2 at one end thereof, and with a suction port 3 at the other end thereof. The casing shell 1 is connected to a bracket (not shown) of a motor through the fixing flange 2. To the suction port 3 of the casing shell 1 is connected a connecting pipe 4 by welding, which has a suction port 6 having a female screw 6*a* on its inner surface. Between the outer end portion of the connecting pipe 4 and the outer surface of the casing shell 1, there is provided a reinforcing cover member 7 having a substantially truncated cone shape and fixed thereto by welding. On the outer surface of the cover member 7 are integrally formed a plurality of radially extending reinforcing bulged portions *7a*, *7a*,—*7a*.

Inside of the casing shell 1 is accommodated an impeller 8, which is fixed on a boss 9. The boss 9 is connected with a free end of a main shaft 10. The main shaft 10 is rotatably supported by a bearing (not shown) and is provided thereon with a seal means 11, which is supported by a casing cover 12 fixed to the casing shell 1.

Between an edge portion 8*a* of the impeller 8 on the suction side thereof and the casing shell 1, there is fitted a ring 13 having a U-shaped cross section for preventing the fluid from flowing backward between the edge portion 8*a* of the impeller 8 and the casing shell 1.

Figure 2:
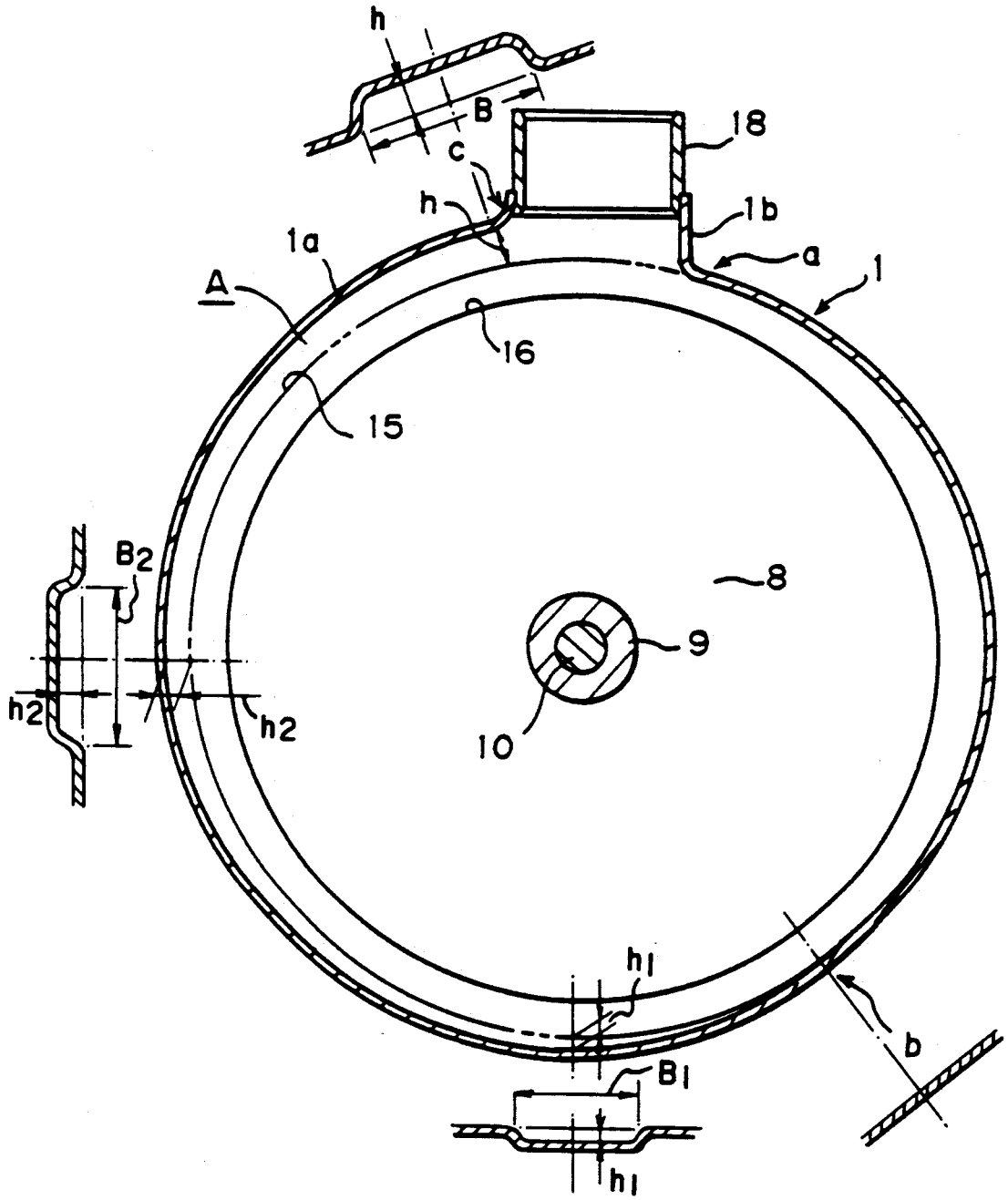
FIG. 2 is a cross-sectional view taken on line II—II of FIG. 1.

According to this embodiment, as shown in FIG. 2, the casing shell 1 is formed to have an inner peripheral circle 15 as a basic circle, the diameter of which is greater than that of the outer peripheral circle 16 of the impeller 8. It is preferred to determine the diameter of the basic circle in a range of 1.05 to 1.10 times of the diameter of the outer peripheral circle of the impeller. When determined below 1.05, the clearance between the circles becomes too narrow, thereby generating considerable noise. On the other hand, when determined above 1.10, the clearance become too wide, thereby deteriorating the performance of the pump.

On the outer peripheral wall of the casing 1 is formed with a bulged portion 1*a* which is radially outwardly bulged with height gradually increasing as going from a starting point b, which is remote in the circumferential direction from the winding starting point a of the casing shell 1, to an ending point c. It is preferred to determine the position of the starting point b remote from the winding starting point a by 90° to 180° in the circumferential direction.

When the starting point b is positioned within 90°, the bulge height of the bulged portion 1*a* becomes too high at the end point c, thereby making it impossible, as will be mentioned later, to obtain the complete bulged shape through only one forming process. On the other hand, if the starting point b is positioned beyond 180°, the effect of providing the bulged portion 1*a* may be lost.

The height of the bulged portion 1*a* is maximum at the ending point c. A pipe-like discharge nozzle 18 is connected to the casing shell by welding so that it extends between the ending point c and the winding starting point a at which no bulged portion is formed. A straight pipe or deverging pipe having a varying diameter may be used as the exhaust nozzle 18.

By this arrangement, in the central region of the width of inside the casing shell 1 is formed with a volute room A, the cross-sectional area of which is adapted to gradually increase in the direction of the fluid flow and becomes maximum at the ending point c.

The required maximum cross-sectional area of the volute room at the ending point c is determined from the fluid flow rate and the fluid flow speed required for the centrifugal pump.

According to this embodiment, the diameter of the inner peripheral circle 15 defining the basic circle is greater enough at the winding starting point a of the casing shell 1 in comparison to the diameter of the outer peripheral circle 16 of the impeller 8. In consequence, the bulge height h above the basic circle 15 at the ending point c is not required to be so high, and, the necessary cross-sectional area at point c can be obtained by providing a relatively small bulge.

Thus, when the casing shell is to be manufactured through a pressing process, the bulged portion 1a can be formed through only one bulging process without the need for an annealing process, because the bulge height of the bulged portion 1a at the ending point c can be made relatively small.

In this embodiment, the gap in the radial direction between the inner peripheral circle 15 of the casing shell 1 and the outer peripheral circle 16 of the impeller 8 is made rather wide. It is known, however, that, in a centrifugal pump of small size and small capacity, even when the above-mentioned gap is wide to some degree, the backward fluid flow from the ending point c towards the winding starting point a is not so great as to cause a substantial deterioration in the pump's performance.

Since the pipe-like discharge nozzle 18 is connected to the casing shell 1 by welding so that it extends between the end point c, where the bulge height is maximum, and the winding starting point a, where no bulged portion is formed, and since the difference in height between the end point c and the winding starting point a is not so great, the wall 1b of the casing shell 1 locating at the winding starting point a may serve as the guide used in prior arts, and as a result, any guide for discharging water is not required to be arranged.

The function of the centrifugal pump having the above-mentioned arrangement is as follows. When a main shaft 10, which is connected to a driving motor (not shown), is rotated, the impeller 8 is rotated integrally thereby sucking the fluid through the suction port 3. The sucked fluid flows through the inside of the impeller 8, is given centrifugal force, and delivered from the peripheral portion thereof into the volute room A. The delivered fluid is moved in a circumferential direction (clockwise direction in FIG. 2) and discharged through the discharge nozzle 18 to the outside.

In the embodiment described above, it is also possible to gradually increase the width of the bulged portion 1a to the ending point c without excessively increasing the height of the same in order to obtain the maximum cross-sectional area of the fluid passage at the ending point c. In such a case, in order to form the bulged portion through only one pressing process without the need for an annealing process, it is desired to form the height of the bulged portion 1a to within one third of the width of the same, at an end point which is the highest point of the bulged portion.

As is clear from the above-mentioned description in this embodiment, since the casing shell 1 has as a basic circle an inner peripheral circle 15 having a diameter greater than the diameter of the outer peripheral circle 16 of the impeller 8, and the bulged portion is bulged radially outwardly from the outer peripheral wall of the casing shell extending from a starting point b remote from the winding starting point a of the casing shell in a circumferential direction to an ending point c while gradually increasing the bulge height in the direction from said starting point to said ending point, the bulge height h above the basic circle 15 is not so great even at the end point c where a maximum height is reached, and, therefore, the bulged portion can be formed through only one pressing process without the need for an annealing process. Further, since the pipe-like discharge nozzle 18 is connected to the casing shell so that it extends between the end point c where the bulged portion is highest and the winding starting a point where no bulged portion is formed, the wall portion 1b of the casing shell at the winding starting point may serve as a guide, and accordingly, there is not required any guide having a projecting shape, which is required in the prior art.

Figure 3:
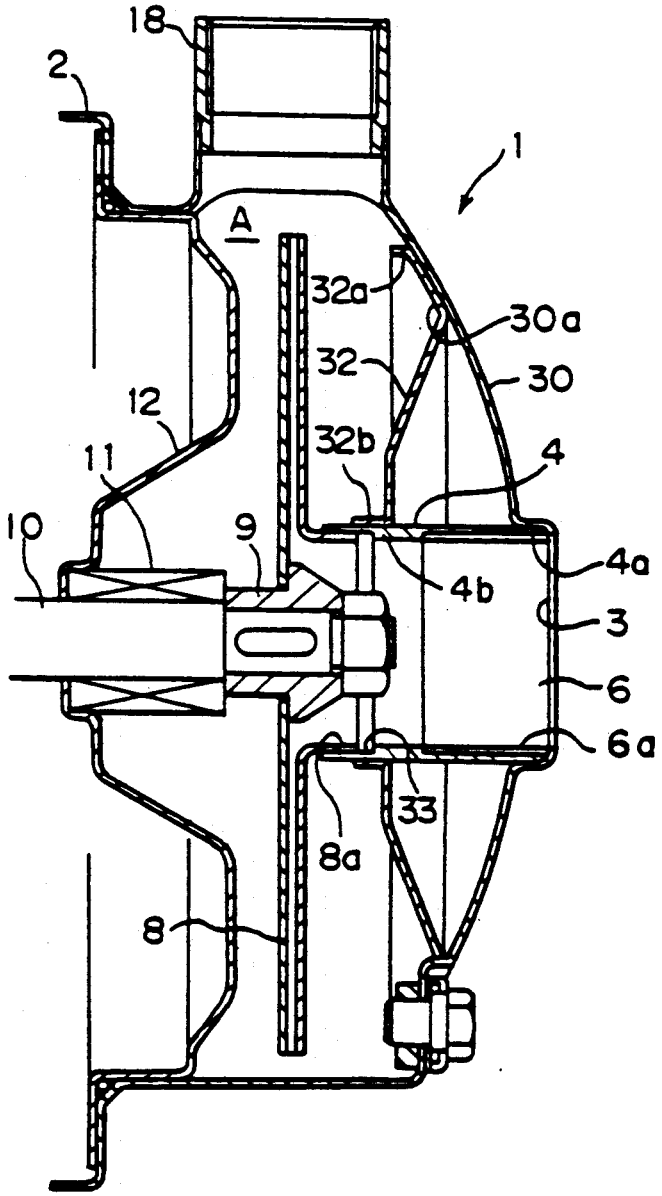
FIG. 3 is a longitudinal sectional view of an centrifugal pump casing according to another embodiment of the present invention.

FIG. 3 shows another embodiment of the invention.

In this embodiment, a wall portion 30 of the casing shell 1 on its suction side is formed so as to have a concave shape and the suction port 3 is open at the central portion thereof. Inside of the concave wall portion 30 is disposed an annular supporting plate 32 and an outer peripheral portion 32a thereof is secured to an inner surface 30a of the wall portion 30. An inner peripheral portion 32b of the supporting plate 32 is bent toward the impeller 8 and formed in a cylindrical shape and the connecting pipe 4 is disposed to extend between the cylindrically shaped inner peripheral portion 32b and the pump suction port 3 in the wall portion 30. One end 4a of the connecting pipe 4 is welded to the pump suction port 3 included in the wall portion 30, while the other end 4b of the connecting pipe 4 is press fitted within the inner peripheral portion 32b. An annular stepped portion 33 is formed on the inner surface of the other end portion 4b of the connecting pipe 4 and the edge portion 8a of the impeller 8 is loosely fitted within the stepped portion 33. A liner ring not shown is provided between the stepped portion and the impeller edge portion.

In this embodiment, since the wall portion 30 is formed to have a concave shape and the annular supporting plate 32 is secured to the inside of the wall portion 30, an internal pressure caused by pump operation is born by a double wall structure constituted by the supporting plate 32 and the wall portion 30. Thus, the strength of the casing shell 1 against the internal pressure is increased and consequently strain imposed on the casing shell 1 caused by the internal pressure may be effectively limited.

In addition, since one end 4a of the connecting pipe 4 is welded to the suction port 3 in the wall portion 30, while the other end 4b of the connecting pipe 4 is press fitted within the inner peripheral portion 32b of the supporting plate 32, the welding between the other end 4b of the connecting pipe 4 and the inner peripheral portion 32b is not required and additional work for correcting the misalignment due to welding can be omitted, which enables a reduction in the production cost.

Figure 4:
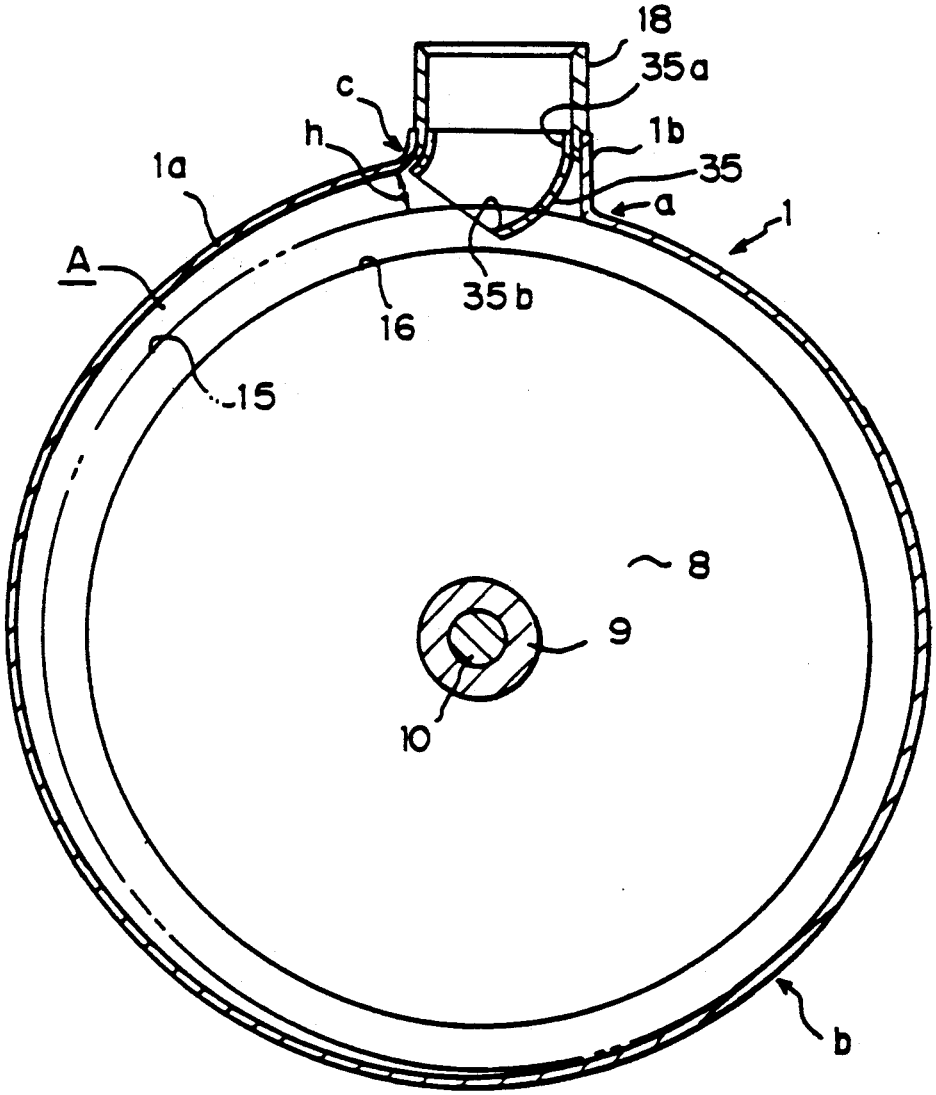
FIG. 4 is a view similar to FIG. 2, but showing a further embodiment of the invention.
Figure 5:
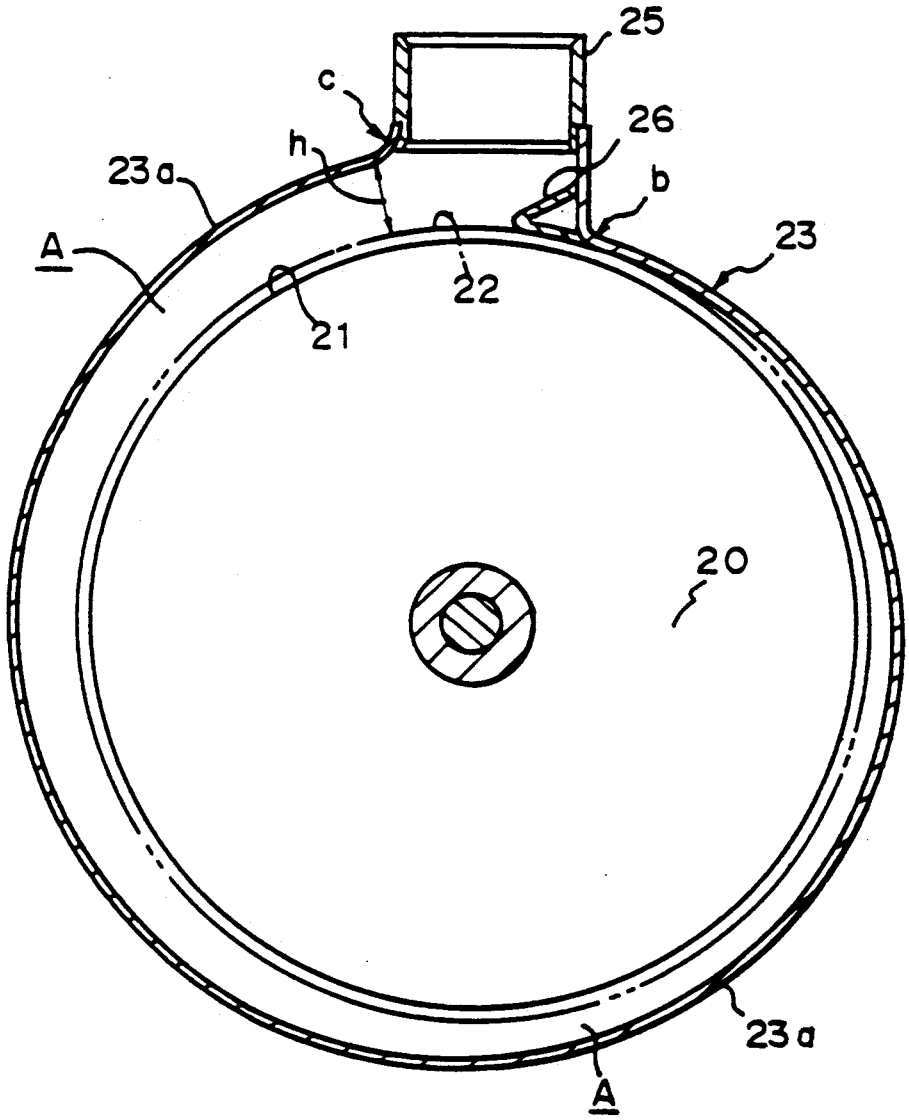
Fig. 5 PRIOR ART
FIG. 5 is a cross-sectional view of a centrifugal pump casing of a prior art.
Figure 6:
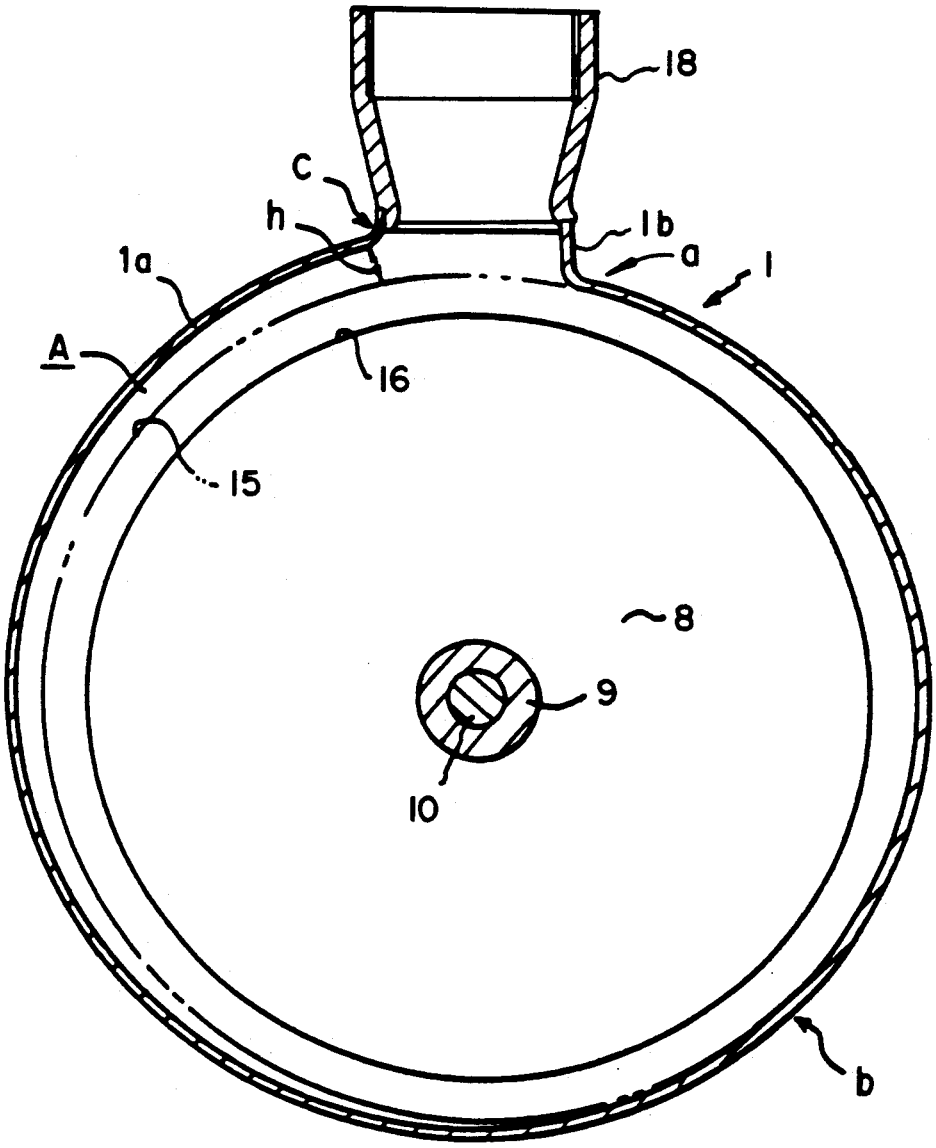
FIG. 6 is a view similar to FIG. 2, but shows a further embodiment of the invention, wherein the discharge nozzle is a diverging pipe.

FIG. 4 shows a further embodiment of the present invention.

In this embodiment, a nozzle element 35 having the shape of a bent pipe is disposed within pipe-like discharge nozzle 18. An outlet portion 35a of the nozzle element 35 is fixed to the inside of the discharge nozzle 18 and the opening of an inlet portion 35b of the nozzle element 35 is directed toward the volute room A at the end point c where the bulged height h of the bulged portion 1a is highest. The sectional area of the opening of the inlet portion 35b is made substantially the same as the sectional area of the volute room A at its end point c and the sectional area of the nozzle element 35 is gradually increased toward the outlet portion 35a thereof.

In this embodiment, a pumped liquid flowing with high velocity from the volute room A toward the discharge nozzle 18 enters the nozzle element 35 and the velocity of the liquid is gradually decreased in this nozzle element 35 and, thereafter, the liquid is discharged from the discharge nozzle 18. Thus, a part of the kinetic energy of the pumped liquid is effectively converted into potential energy to increase pump pressure during its decrease in velocity and, therefore, the pump performance can be improved. In addition, since the nozzle element 35 is formed of a moderately bent pipe, the pumped liquid is effectively discharged from the volute room A through the discharge nozzle 18 without causing substantial turbulance.

What is claimed is:

1. A method of forming a casing shell of a centrifugal pump casing, said casing shell accommodating a rotary impeller therein and having as a basic circle an inner peripheral circle having a diameter greater than the diameter of an outer peripheral circle of the impeller, with a bulged portion bulged radially outwardly and being integrally formed on an outer peripheral wall of said casing shell, said bulged portion extending from a starting point remote from a winding starting point of said casing shell in a circumferential direction to an end point while gradually increasing a bulge height in the direction from said starting point to said end point, thereby forming a volute room, said method comprising the steps of:

forming said bulged portion through only one bulging process without a need for an annealing process.

2. A method of forming a casing shell of a centrifugal pump casing claimed in claim 1, comprising the further steps of:

shaping a wall portion of said casing shell on its suction side to have a concave shape with a pump suction port open at a central portion thereof;

disposing an annular supporting plate inside of said concave wall portion with an outer peripheral portion thereof being secured to an inner surface of said wall portion with an inner peripheral portion thereof being formed in a cylindrical shape;

welding a first end of said connecting pipe to said pump suction in said wall portion, said connecting pipe being disposed to extend between said cylindrically shaped inner peripheral portion and said pump suction port formed in said wall portion; and press-fitting a second end of said connecting pipe within said inner peripheral portion of said supporting plate.

3. A process of forming a casing shell of a centrifugal pump casing as recited in claim 2, further comprising the steps of:

forming an annular stepped portion on the inner surface of said second end of said connecting pipe, wherein an edge portion of said impeller is loosely fitted within said stepped portion.

4. A method of forming a casing shell of a centrifugal pump casing as recited in claim 1, and further comprising the steps of:

forming a nozzle element in the form of a bent pipe;

disposing said nozzle element within said pipe-like discharge nozzle; and fixing an outlet portion of said nozzle element to the inside of said discharge nozzle, wherein an inlet opening of said nozzle element is directed toward said volute room at said end point where said bulged height of said bulged portion is highest, and a sectional area of said inlet opening is substantially the same as a sectional area of said volute room at said end point thereof.

5. A process of forming a bulged portion in a casing shell of a centrifugal pump casing as recited in claim 4, comprising the further step of gradually increasing the sectional area of said nozzle element toward said outlet portion thereof.

* * * * *